United States Patent [19]

Holder et al.

[11] 4,354,364

[45] Oct. 19, 1982

[54] DRY-CLEANING SYSTEM

[76] Inventors: H. Dennis Holder, 16052 Wedgeworth Dr., Hacienda Heights, Calif. 91745; Herb L. Goodman, 17321 Ave. de la Herradura; Michael Favish, 17315 Ave. de la Herradura, both of Pacific Palisades, Calif. 90272

[21] Appl. No.: 242,274

[22] Filed: Mar. 10, 1981

[51] Int. Cl.[3] ..... D06F 43/08

[52] U.S. Cl. ..... 68/18 R

[58] Field of Search ..... 68/18 R, 18 C, 18 F; 34/77, 78

[56] References Cited

U.S. PATENT DOCUMENTS

| | | | |
|---|---|---|---|
| 2,019,896 | 11/1935 | Edlich | 68/18 C X |
| 2,659,224 | 11/1953 | Duncan | 68/18 C |
| 3,186,106 | 6/1965 | Cobb et al. | 34/77 X |
| 3,203,209 | 8/1965 | Paulick | 68/18 R X |
| 4,111,034 | 9/1978 | Hubner | 68/18 R X |
| 4,238,122 | 12/1980 | Snyder et al. | 34/78 X |

*Primary Examiner*—Philip R. Coe

*Attorney, Agent, or Firm*—Bruce L. Birchard

[57] ABSTRACT

By measuring the volume of return flow of cleaning liquid, such as perchlorethylene, from the still, reclaimer and sniffer portions of a dry-cleaning system to the main or reserve cleaning-agent storage tank thereof, the efficiency of the system's use of the cleaning agent can be continuously audited and the steam-heating of the still, reclaimer and sniffer portions can be limited in time to those times when such heating produces a flow of re-claimed cleaning fluid to the main or reserve tank, thus limiting the consumption of the energy consumed in the steam generation process while conserving dry-cleaning liquid and assuring optimum system operation.

8 Claims, 3 Drawing Figures

DRY-CLEANING SYSTEM

BACKGROUND OF THE INVENTION

1. Field of the Invention

This invention relates to dry-cleaning systems and, more specifically, to such systems using re-circulated cleaning liquid.

2. Prior Art

Dry-cleaning systems in the past have failed to audit the use or consumption of the cleaning fluid in the system. A crude measure of overall consumption was had by measuring total loss at the main tank, but where in the system the consumption was occurring was not known. The effectiveness of the re-capture of the cleaning fluid was also unknown. Steam was fed into the various elements of the system, such as the reclaimer or still, without any concern for whether a cleaning liquid condensate was flowing out of that element back to the main or reserve tank. Thus, useless heating energy dissipation was occurring. Also, in the event of blockage in the return line, cleaning fluid was being inadvertently dumped into the sewage system.

Therefore, it is an object of this invention to overcome the disadvantages of prior art systems, as set forth hereinbefore.

It is a still further object of this invention to provide accurate auditing of cleaning-fluid useage.

It is a still further object of this invention to minimize energy consumption in a dry-cleaning system.

SUMMARY OF THE INVENTION

By utilizing positive displacement flowmeters in each of the return lines to the cleaning-liquid storage tank in a dry cleaning system and auditing the return flow volume from a module of the system from which reclamation of cleaning liquid is being induced by the introduction of steam, the injection of steam into that module is automatically terminated when liquid cleaner stops flowing back to the storage tank, thus conserving energy in the steam generator. The return-flow auditing also permits analysis of the performance of each module insofar as its consumption or loss of liquid cleaner is concerned, thus permitting the operator to correct defective modules in the system.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings, in which:

DETAILED DESCRIPTION OF THE PREFERRED EMBODIMENTS

Figure 1:
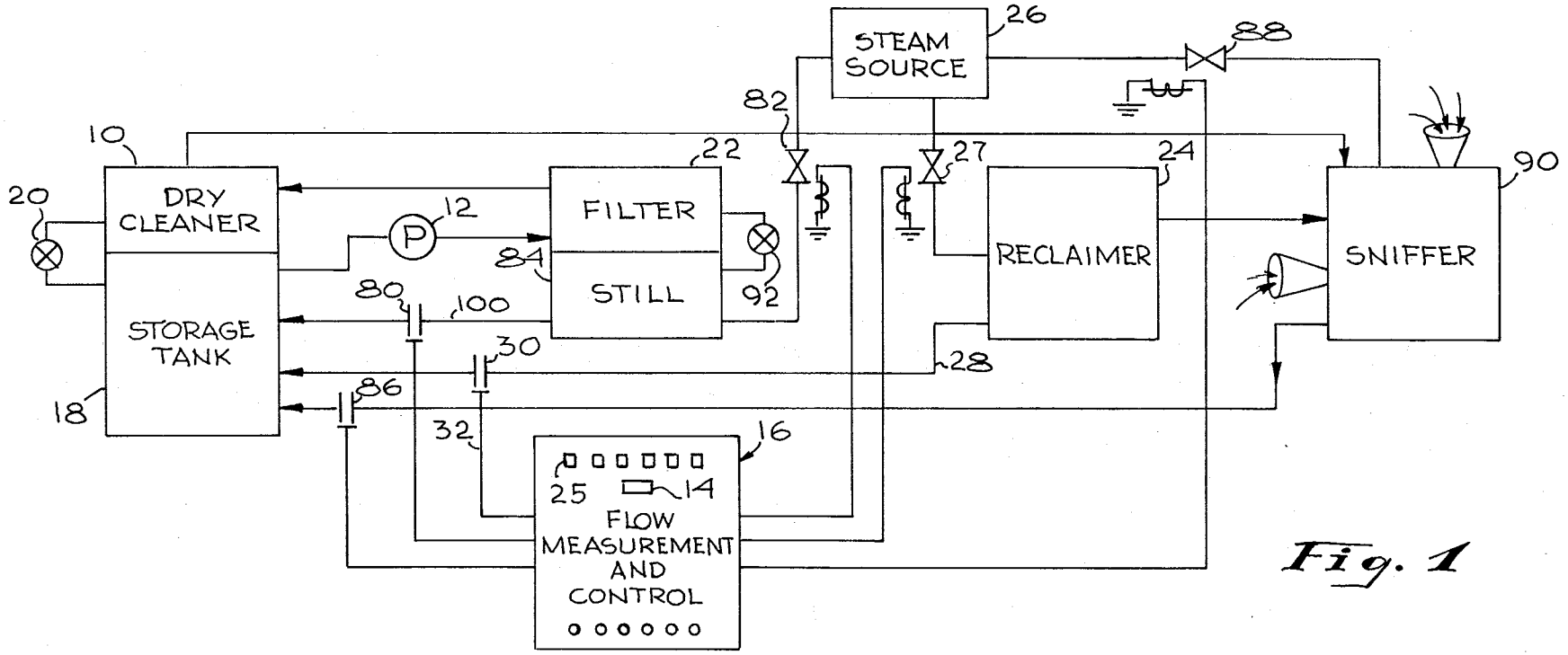
FIG. 1 is a block diagram, partially schematic in nature, of a dry cleaning system accoding to the present invention.

In FIG. 1, clothes or other materials to be cleaned are placed in dry cleaner 10. Activation of pumps 12 by actuation of a pushbutton, such as pushbutton 14 on flow measurement and control unit 16, results in the pumping of the cleaning fluid (usually perchlorethylene) out of storage tank 18 into dry cleaner 10. After the cleaning cycle, which includes a centrifuged extraction step, the cleaning fluid not retained by the material being cleaned or lost through evaporation is returned to tank 18 through valve 20, which may be automatically actuated.

The cleaning fluid pumped to dry cleaner 10 passes through filter 22 which may comprise diatomaceous earth and/or activated charcoal. Filter 22 removes solid foreign particles, odors and other undesired constituents of the liquid stored in tank 18. Some cleaning liquid is also occluded in filter 22.

In the system of FIG. 1, after the cleaning cycle the clothes are physically removed from dry cleaner 10 and carried to reclaimer 24. In that process, part of the cleaning liquid retained by the cleaned material evaporates into the ambient air.

Upon actuation of a control element, such as button 25 on control 16, steam from steam source 26 is fed through solenoid operated valve 27 into reclaimer 24 causing the low-boiling-point cleaning liquid retained by the cleaned material, such as clothes, to vaporize. Reclaimer 24, which is a conventional dry-cleaning system module, includes cooling or condensation coils and collection means coupled to output pipe 28 which causes condensed and collected cleaning-fluid to flow by gravity to storage tank 18 through flowmeter 30. Flowmeter 30 is a positive displacement flowmeter of the type sold by Kent Meter Sales, Inc., 7 East Silver Springs Blvd., Ocala, Fla. 32670 under the name MiniMajor. Such a unit is available with a pulse head. The pulse head, which includes a reed switch, puts out 1667 contact closures per gallon of liquid flow through the meter. Signals representative of those pulse closures are transmitted through cable 32 to measurement and control Unit 16. Closures may be counted any one of a multitude of means, either electro-mechanical or purely electronic including scaling chips and counter chips. An accumulating register may also be provided to give the total flow of liquid through flowmeter 30. Scaling and counting equipment compatible with the Kent flowmeter is also available from Kent Sales at the aforesaid address.

Figure 2:
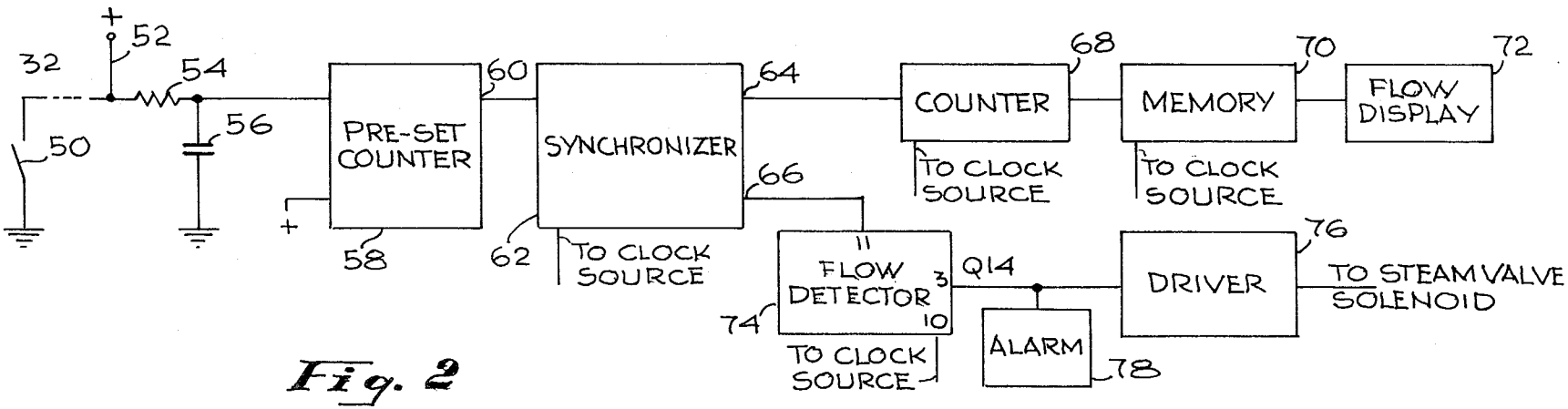
FIG. 2 is a block diagram of the electrical system utilized in the flow and measurement portion of the system of FIG. 1; and, FIG. 3 is a block diagram of a modified form of the system of FIG. 1.

A block diagram of electrical circuits which may be associated with the Kent flowmeter to achieve the ends of this invention are set forth in FIG. 2. In FIG. 2 the dry contacts 50 of the flowmeter (not shown) have applied to them through cable 32 a potential, for example 15 volts d.c., from terminal 52. A filter including resistor 54 and capacitor 56 is provided to eliminate high frequency noise which may appear on cable 32 because of its length. Contacts 50 close 1667 times per gallon of flow thru the flowmeter, for example, if flowmeter 30 is a Kent flowmeter. The 1667 pulses per gallon are fed to pre-set counter 58. Pre-set counter 58 is an 8-bit binary counter using, for example, a type MC 14569 chip from Motorola, Inc. of Chicago, Ill. Pre-set counter 58 is so designated because it puts out one pulse at terminal 60 for each 1/10 of any predetermined unit such as a gallon, liter or Imperial gallon, passing through flowmeter 30. That pulse is passed to synchronizer 62 the purpose of which is to synchronize the off and on transitions of the pulses from output terminal 60 of pre-set counter 58. A pair of D-type flip-flops, the circuits for which are well known, accomplishes the desired end.

Out of synchronizer 62 come two signals, one at terminal 64 and the other at terminal 66. The one at terminal 64 corresponds to the "on" pulses from terminal 60 of pre-set counter 58. The one at terminal 66 corresponds to the "off" condition of the pulses from terminal 60. The first signal is fed to counter 68 with its associated memory 70 and a LED flow display 72. The circuits for elements 68, 70 and 72 are conventional and need not be dwelt upon here. The total cleaning liquid flow, to any particular moment, and in any particular return pipe, such as pipe 28, is displayed on flow display 72.

The "off" phase of the signal from terminal 60 is fed to flow detection unit 74. This unit may include a 14-bit binary counter chip such as the MC 14020. This chip outputs a signal Q14 at pin 3 every 10 to 20 minutes if the "off" condition is not interrupted by a pulse from terminal 60 during that period, a condition that would indicate no flow in the related return pipe. If the signal Q14 appears, it triggers drives unit 76 as well as alarm unit 78. Driver unit 76 develops, in the absence of a Q14 signal, in other words when return liquid is flowing; a potential and current for operating the solenoid in the steam valve, for example valve 27 in FIG. 1, thus permitting steam to flow into the module, e.g., reclaimer 24, which is still yielding a return flow of cleaning fluid. If a Q14 signal appears, driver unit 76 is turned "off", i.e. no operating power is provided to an associated steam valve and it closes, stopping the flow of steam to a module which is no longer yielding any return flow of cleaning fluid. Driver unit 76 may include trices to achieve the necessary current level to drive associated solenoid operated steam valves.

This analysis applies to the control circuits for any of the modules of FIG. 1 where steam is being used to reclaim perchloethylene or other cleaning fluid. For example, flowmeter 80 controls valve 82 connected to still 84 and flowmeter 86 controls valve 88 connected to sniffer 90.

The function of still 84 should now be explained. Filter 22 absorbs cleaning fluid along with dirt. It also collects oil and water. This admixture is passed into still 84 by opening valve 92. Steam is then injected to vaporize the cleaning fluid and, after condensation, it returns thru line 100 and flowmeter 80 to storage tank 18. The quantity returned is calculated by the circuit of FIG. 2 and steam valve 82 shuts off automatically when return flow stops.

Sniffer 90, as its name implies, picks up cleaning fluid vapors that have escaped into the air and are found at floor level, or higher. Intake fans force the fumes into sniffer 90. Other fumes from dry cleaner 10 and reclaimer 24 are taken through pipes to sniffer 90. Steam is injected through valve 88 until there is no longer a return flow of cleaning fluid. Flow measurement and control module 16 permits checking of the other modules and their return conditions individually and selectively.

Figure 3:
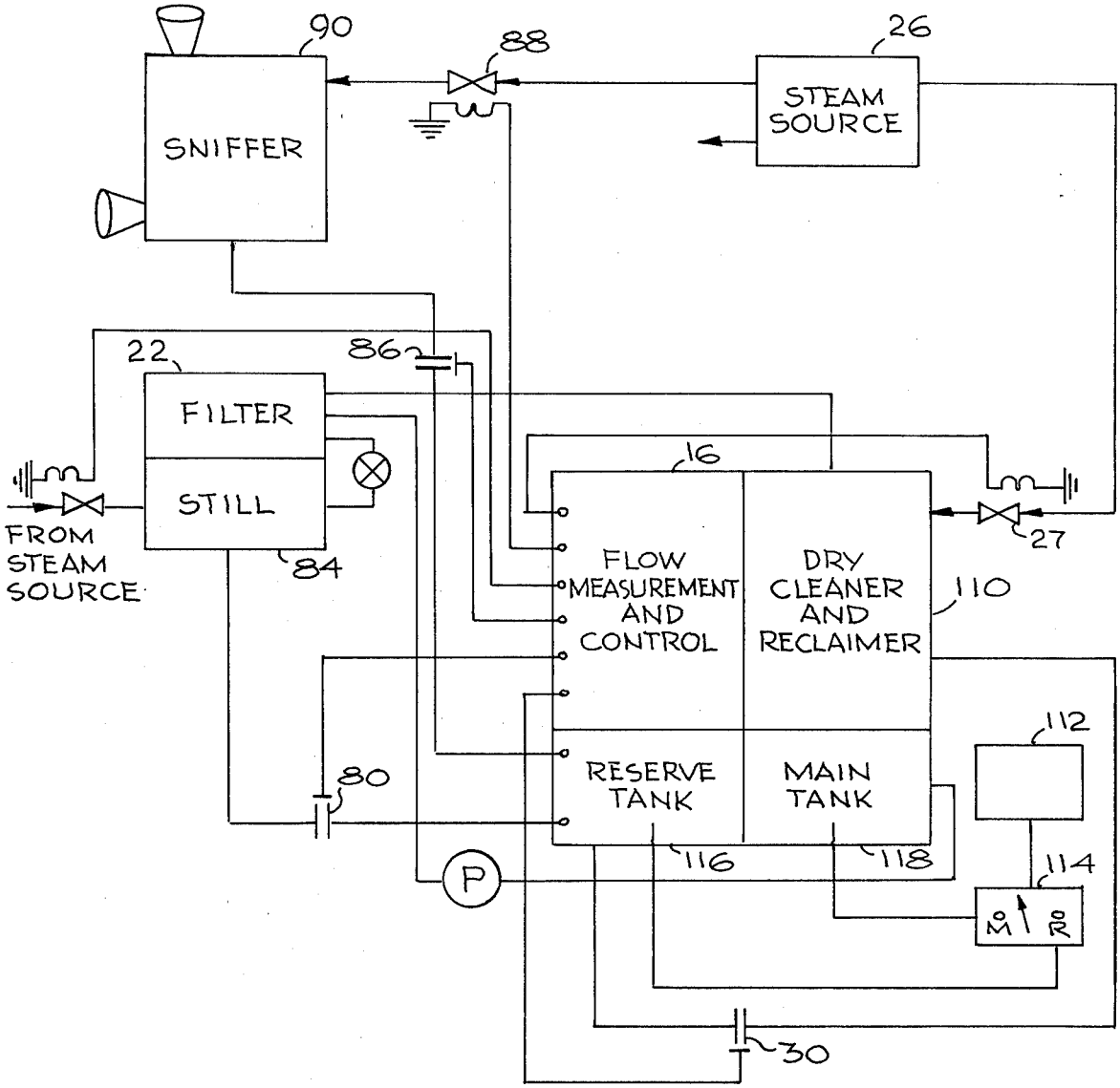

In FIG. 3, a "dry-to-dry" or "hot" unit is shown. With such a unit it can be seen that the dry cleaner and re-claimer are combined in a single package 110. As a result the clothes or other materials being cleaned are not carried through the working space from the dry cleaner to the re-claimer as they were in connection with the system of FIG. 1. Such a system has less problems of injury to the employees or operators and less loss of the cleaning fluid to the atmosphere. The operation of the automatic steam valve control by way of flow measurement and control unit 16 is the same as was described in connection with FIG. 1.

The system of FIG. 3 shows one additional feature. That is that display 112 which is intended to show the volume of cleaning fluid in a tank, can, by a reason of switching transducer 114 between either reserve tank 116 or main tank 118 read, selectively, the volume of cleaning fluid in each tank, individually.

While a particular embodiment of this invention has been shown and described, it will be evident that those skilled in the art that variations and modifications of that embodiment may be made without departing from the scope or spirit of this invention. It is the purpose of the appended claims to cover all such variations and modifications.

What is claimed is:

1. A dry-cleaning system, including:

cleaning fluid storage means;

at least one mdoule, from which cleaning liquid is to be reclaimed;

a return line from said at least one module to said storage means;

a flowmeter connected in said return line and having first output terminals which exhibit changes in electrical conditions across said first output terminals in response to a flow of cleaning fluid through said return line;

a source of steam;

a steam line coupled between said source of steam and said at least one module;

a solenoid-operated valve connected in said steam line for controlling the flow of steam through said steam line to said at least one module, said solenoid-operated valve having a pair of control terminals; and, flow measurement and control means coupled between said first output terminals and said control terminals for opening said solenoid-operated valve and permitting steam flow therethrough only in the presence of said changes in electrical conditions across said first output terminals.

2. A system according to claim 1 in which said changes in electrical conditions across said first output terminals are changes in electrical conductivity therebetween.

3. Apparatus according to claim 1 in which said measurement and control means includes counting means coupled to said first output terminals and responsive to said changes in electrical conditions thereacross to measure the flow of cleaning liquid through said return line.

4. Apparatus according to claim 3 which includes, in addition, display means coupled to said counting means for displaying the volume of cleaning fluid flowing through said return line.

5. A system according to claim 1 in which said changes in electrical conditions across said first output terminals are changes from open circuit to closed circuit conditions.

6. Apparatus according to claim 1 in which said at least one module is a cleaning fluid reclaimer.

7. Apparatus according to claim 1 in which said at least one module is a sniffer.

8. Apparatus according to claim 1 in which said storage means comprises a main tank and a reserve tank;

a volume display having a transducer; and, means for switching said transducer between said main tank and said reserve tank.

* * * * *